US005141166A

United States Patent [19]

Maynard, Jr.

[11] Patent Number: 5,141,166

[45] Date of Patent: Aug. 25, 1992

[54] SINK DRAIN DEVICE FOR FRAGMENTING AND FREEING FOOD DEBRIS

[76] Inventor: Stuart T. Maynard, Jr., 12 Lookout Rd., Asheville, N.C. 28805

[21] Appl. No.: 653,904

[22] Filed: Feb. 12, 1991

[51] Int. Cl.[5] ..... B02C 23/36

[52] U.S. Cl. ..... 241/46.015; 4/287; 241/46.016

[58] Field of Search ..... 241/169.1, 46 R, 169.2, 241/46 A, 46 B, 100.5, 25.7 G, 46.04, 46.08, 46.11, 46.17; 30/296.1

[56] References Cited

U.S. PATENT DOCUMENTS

| | | | |
|---|---|---|---|
| 1,434,066 | 10/1922 | Rodgers | 241/46 B |
| 1,614,358 | 1/1927 | Gandillon | 241/100.5 |
| 2,479,485 | 8/1949 | Frank | 4/287 |
| 3,122,969 | 3/1964 | Shames et al. | 241/169.1 X |
| 3,374,958 | 3/1968 | Shive | 241/46 B |
| 4,284,248 | 8/1981 | Adams | 241/169.1 X |
| 4,309,823 | 1/1982 | Antolino et al. | 241/169.1 X |

FOREIGN PATENT DOCUMENTS

| | | | |
|---|---|---|---|
| 1141502 | 2/1983 | Canada | 241/100.5 |

*Primary Examiner*—P. W. Echols

[57] ABSTRACT

A device that can be inserted in an ordianry sink drain and disintegrate trapped debris by rotary motion of a rotor blade. Debris in flowing drainage is trapped in perforations of a receptacle cylinder. The rotor blade which is mounted centrally within a receptacle cylinder is actuated by linear strokes of a steeply pitched threaded rod passing through the threaded bore of the rotor. The upper part of the threaded rod includes a finger grip and a perforated cap piece with a mated and perforated gate cap which may function as an upper strainer obstacle when fitted within the main cylinder of the sink drain. When the cap is closed and moved within the drain main cylinder, it can impart a final compressive force downward.

10 Claims, 4 Drawing Sheets

SINK DRAIN DEVICE FOR FRAGMENTING AND FREEING FOOD DEBRIS

BACKGROUND OF THE INVENTION

While most sinks have at least a common basket strainer to catch food debris from going down the drain, such baskets are able to catch many food fragments which can safely pass down a drain, along with larger pieces that should not. The basket requires manual removal and shaking of the basket contents into compost or garbage containers. Some kitchen proprietors elect to have a garbage or food "disposal" which can fragment all matter to a flushable size.

A number of food disposal devices are known to allow food material to be safely reduced to fragment size which can be carried through household plumbing to larger sewage conduits. In the post World War II period there was an upsurge of electrically powered food "disposal" units to be attached at the base of a sink. Besides requiring assurance of separation of electrical components from moisture, the many electrically powered disposals purposely keep rotors out of reach of hands. The out of sight out of mind context of rotors, also means that these are not available to view for cleaning or inspection and guards must be placed to avoid losing hard objects into the disposal where these damaging objects cannot be easily retrieved.

The plethora of electrically powered devices in a modern kitchen may mean that mechanical assists have been overlooked by inventors for those in the kitchen who continue to prefer a given task in the manual mode. Yet, many households do not have sink disposals and the ever-clogged baskets of the average sink must be diligently cleaned. A few of the ergonomic disadvantages of operating the simple device of a common basket are:

1. When a basket is overwhelmed with food particles it must be stirred manually, keeping particles suspended, so that a filled sink can be drained. Stirring does not physically send all particles down the drain, but only suspends them temporarily allowing temporary fluid drainage. The task of stirring is simple but tedious, with the fingers or some piece of kitchen ware as the tool.

2. Once a sink is drained, the basket allows inspection of food debris, but food particles are adherent because of surface tension of the wet, flexible, and soggy matter. To empty the contents into a garbage container, the user may tap the basket upside down or wipe it with fingers or cloth. Even then, the experienced dishwasher knows the need of having to rinse small adherent particles in a spray and of flushing the lower drain assembly, which the basket was meant to protect.

3. It is easy to procrastinate in flushing away small adherent food particles only to allow sugars and nutrients to be leached onto the sink and drain surfaces where the growth of fungus films is the result.

The above problems are not associated only with large quantities or large sized pieces of food debris, and the problems are known even to those kitchen operators who diligently scrape and prepare dishware for the process of washing. Both the diligent "scrapers", who do not feel compelled to own a "disposal", and the disposal owner, who has a second sink lacking the device, encounter the everyday task of removing small amounts of food debris from a sink.

OBJECTS OF THE INVENTION

Maintaining a simple basket filter on a kitchen sink is an ongoing ritual of tasks involving wiping, stirring, removal, shaking, rinsing, etc.; such tasks may be reduced in frequency with a manually operated tool which also can be removed, inspected and cleaned as necessary. It is intended to provided a tool with the capability to fragment the types of soft matter that clog an ordinary drain basket. The mechanism need not accomplish all tasks, such as to grind up tougher matter such as orange peels or seeds. The mechanism should be adaptable to fit within an ordinary sink drain configuration with minimal modification of existing components common in the industry.

BRIEF DESCRIPTION OF THE INVENTION

The invention may be adapted to the constraints of an ordinary drain which receives a common "basket strainer". Such a drain assembly consists of two cylinders: (1) a main cylinder which is commonly $3\frac{1}{4}''$ in diameter and approximately $1\frac{3}{4}''$ in height with a flared top which merges with the sink bottom and (2) a smaller and lower cylinder which is concentric and about 2" in diameter by $\frac{1}{2}$ in depth. The lower cylinder is a recess which commonly receives the rubber plug portion of the drain basket; the bottom of the lower cylinder commonly has a slot to receive the pin of a common drain basket in its lower (plugged) position.

The common drain basket may be permanently removed from use since the invention may provide a funnel like cup that is fitted to the main cylinder and also in the lower cylinder of the common drain. The funnel like sides of the cup allow debris to converge into a cylindrical recess which has perforations for egress of liquid and detention of debris. A rotor piece is mounted centrally in the cylindrical recess, being held in place by a retainer nut on the outer and bottom side of the cylindrical recess.

The rotor and funnel cup may be removed from the drain as a unit, much as the everday drain basket can be removed for cleaning and inspection.

The rotor is provided with a central bore with steep pitch threads which match a threaded shaft that may be pushed up and down, causing alternate clockwise and counter clockwise rotation of the rotor. The threaded shaft may protrude through the commonplace slot provided in drain assemblies for the commonplace drain basket, so long as the shaft does not reach the bottom of the sink trap pipe.

At the top of the threaded shaft a disk-like cap is fixed along with a knob or finger grip. This cap has a diameter that may receed within the diameter of the main cylinder of the sink drain assembly whenever the threaded shaft is pushed downward to the hilt. Of special note is that the last approximate inch of travel within the main cylinder produces a forceful compression of the fluid which is draining through the perforated recess of the funnel piece. This compression may eject through the perforations those particles of debris which have been ground up or agitated by the rotor action.

In the cap piece there are concentrically arranged perforations and a second perforated disc is centered on the knob of the cap assembly, such that it can be rotated for its perforations to align with or obstruct the perforations of the cap. By rotation of the second disc, fluid may drain through the cap. The cap assembly may be mounted on the threaded shaft with its convexity upward or downward. The invention allows for a cap piece, which is recessed into the main cylinder and mounted on its threaded shaft, to drain fluid but trap debris with its perforations. This is the traditional function of the drain basket and indeed the cap and shaft can be lifted out for the conveyance of debris to a garbage container, especially if the cap is mounted with convexity downward.

However, if the user prefers to drain most debris along with the water discharge of the sink, then the shaft may be plunged to rotate the rotor which shears debris against the wall of the perforated recess of the funnel piece. As water flows through the recess perforations, trapped debris is held in place by suction at the perforations such that the rotor, which has a small clearance with the side walls of the recess, can shear the particles.

As previously described, the cap (with its perforations closed) may provide the final impetus for ejection of particles at the perforations of the lower recess, during the compression phase of the cap moving within the main cylinder.

When used to fragment and eject debris, drainage of a filled sink is accomplished simply by lifting the cap and shaft assembly to allow drainage through the perforations of the lower recess. The amount of rotor activity is determined by the amount of vertical strokes manually applied to the shaft.

THE DRAWING FIGURES

| Drawing Reference List | |
|---|---|
| 1 the invention | 27 cap piece |
| 2 a common sink drain | 28 O ring groove |
| 4 main cylinder of sink drain | 29 knob |
| 5 flared top of sink drain | 30 gate disc |
| 6 plug recess of sink drain | 31 gate disc perforation |
| 7 concentric drain slot | 32 gate disc nub |
| 8 basket pin slot | 34 central bore of rotor |
| 10 cap assembly | 36 machine thread end of shaft |
| 10A-10B compression positions | 37 perforations of cap piece |
| 12 threaded shaft | 38 receptacle O ring groove |
| 14 receptacle assembly | 40 retainer nut |
| 16 funnelling portion of receptacle | 42 footing protrusion |
| 18 rotor recess | 44 recess (of knob 29) |
| 19 rotor | 47 gate disc central diameter |
| 20 recess bottom perforation | 48 recess outer diameter |
| 21 recess sidewall perforation | 50 corner perforation |
| 22 recess dormer perforation | 46 concentric cap slot |
| 24 insertion path of receptacle | |
| 26 insertion path of rotor recess | |

DESCRIPTION OF THE ILLUSTRATED EMBODIMENT

The invention may be placed removably within a conventional sink drain which is fixed and interposed between a sink and the drain pipe. Where preferred, portions of the invention could be incorporated into fixed sink drain assembly, as will be obvious from an examination of the components.

Figure 1:
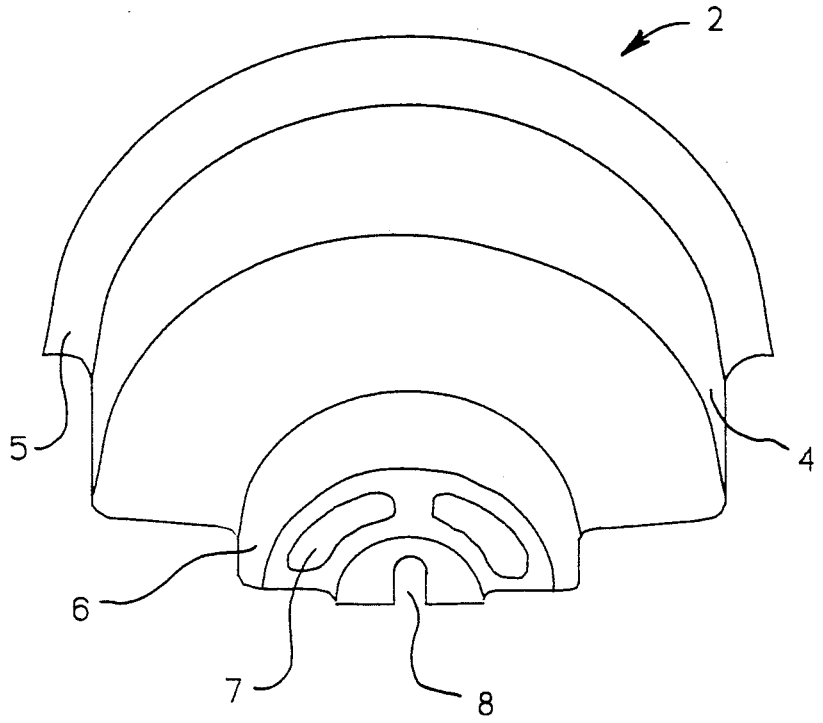
FIG. 1 is shows the outline of an ordinary sink drain in a perspective view cut away across the diameter.

FIG. 1 is a perspective cut away view of a common sink drain indicated by 2, which has a main cylinder region 3 and a plug recess 6. Typically, the bottom of the plug recess 6 has a basket pin slot 8, which is centrally placed, and concentric drain slots 7 which allow fluid egress. The common sink drain 2 attaches to the sink at its flared lip 5, which rests on an inner surface of the sink bottom, being clamped in place by a threaded ring at the main cylinder. At the outside of the plug recess 6, other threads allow for a threaded retainer ring to connect the sink drain to piping which usually leads directly to a curved "trap" pipe.

Figure 2:
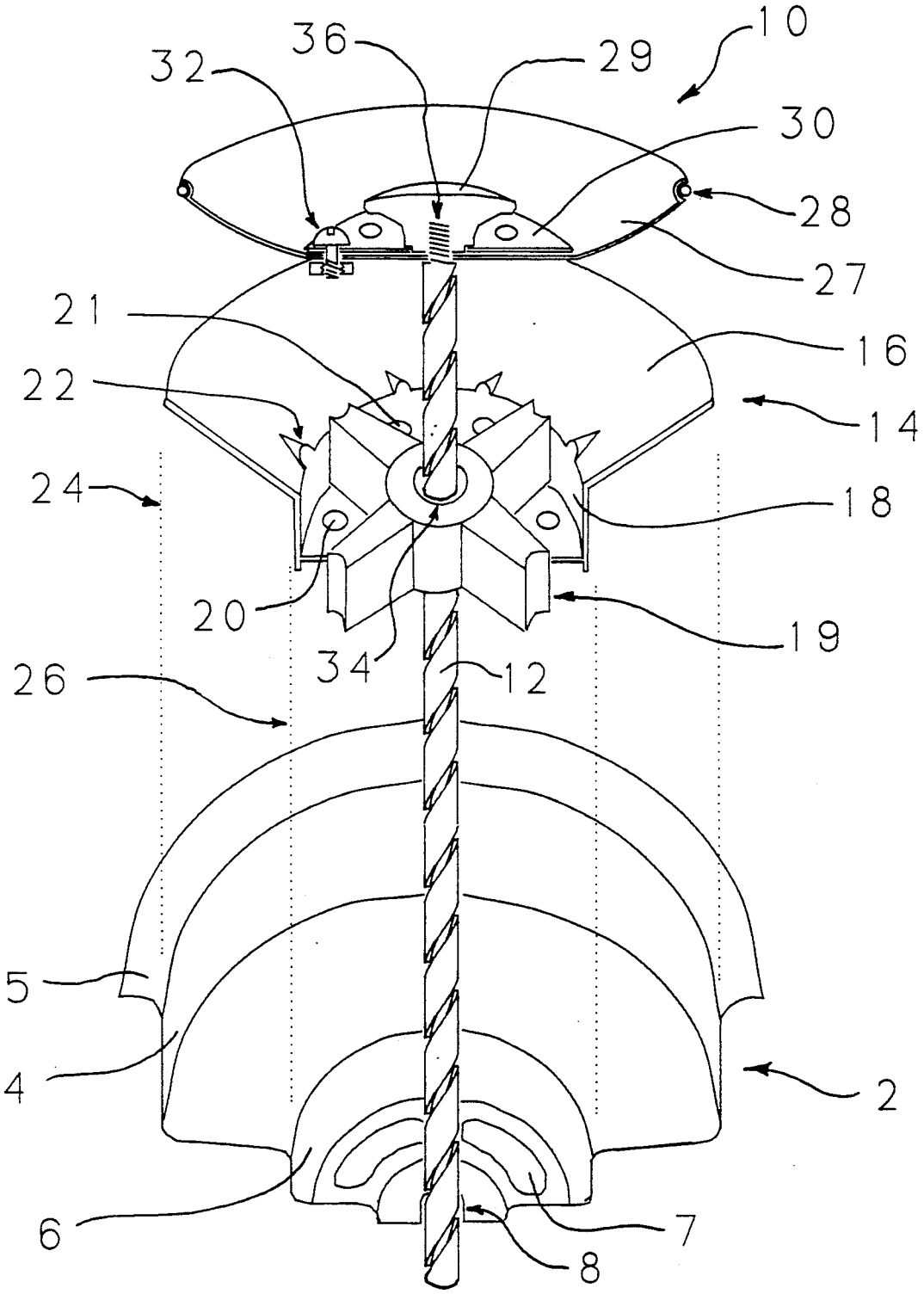
FIG. 2 is a perspective view of the invention with a frontal cut away.

FIG. 2 is a perspective view with a frontal cut away depicting the invention and a common sink drain. The common sink drain is depicted in a frontal cutaway across its diameter. Identified by numerals on the common sink drain are: main cylinder region 3, flared lip 5, plug recess 6, concentric drain slot 7, and basket pin slot 8 with threaded shaft 12 protruding through.

The threaded shaft 12 also passes through a receptacle assembly 14 which includes a funneling portion 16 which has a diameter that is able to fit snugly within the diameter of the main cylinder 3 of the sink drain, as indicated by the dotted line insertion path 24.

The lower portion of the receptacle assembly 14 includes a rotor recess 18 which is cylindrical and contains a rotor 19 which fits with a clearance against the cylindrical wall of the rotor recess 18 that will allow shearing action against food debris that may fall into the recess. The rotor recess 18 contains a variety of perforations which allow egress of liquid from a sink above to flow to the openings 7 of the common sink drain below. The perforations depicted are bottom perforations 20, sidewall perforations 21, and dormer perforations 22; as liquid is drained, food debris is sucked into and caught by these perforations due to the negative pressure created by liquids draining in the household plumbing below. Since the food debris can be held in place by suction, the close passage of a rotor blade edge can shear the debris. It is preferred that the rotor recess 18 be a diameter which can fit within the diameter of the typical plug recess 6 of a common sink drain as indicated by insertion path dotted line 26.

The rotor 19 is threaded within its central bore 34 to match the threaded shaft 12, such that it is rotated as a consequence of linear strokes of the threaded shaft through the rotor. The pitch of the threads is sufficiently steep to readily convey linear motion into rotation. The rotor 19 spins within a central rotor mounting hole in the bottom of rotor recess 18 which, along with a retainer nut, is shown best in FIG. 3 which follows.

Continuing on FIG. 2, the cap assembly 10 is attached to the top of threaded shaft 12 at a central hole in its cap piece 27 by a knob 29 which is screwed at the machine thread end 36. The cap assembly including cap piece 27 is shown in perspective and frontal cross-section through its diameter.

In FIG. 2 the cap piece is shown mounted with concavity upward and it carries perforations which may allow egress of liquid and entrapment of debris within the concavity. This orientation may be preferred for draining fluids containing debris that the operator does not want carried lower into the receptacle assembly 14 or the common sink drain. The cap piece 27 diameter should be able to fit within the diameter of the main cylinder 3 of the sink drain. A perimeter groove 28 may be provided on the cap piece for the mounting of an O ring to improve the fit of the cap assembly within the main cylinder.

Figure 3:
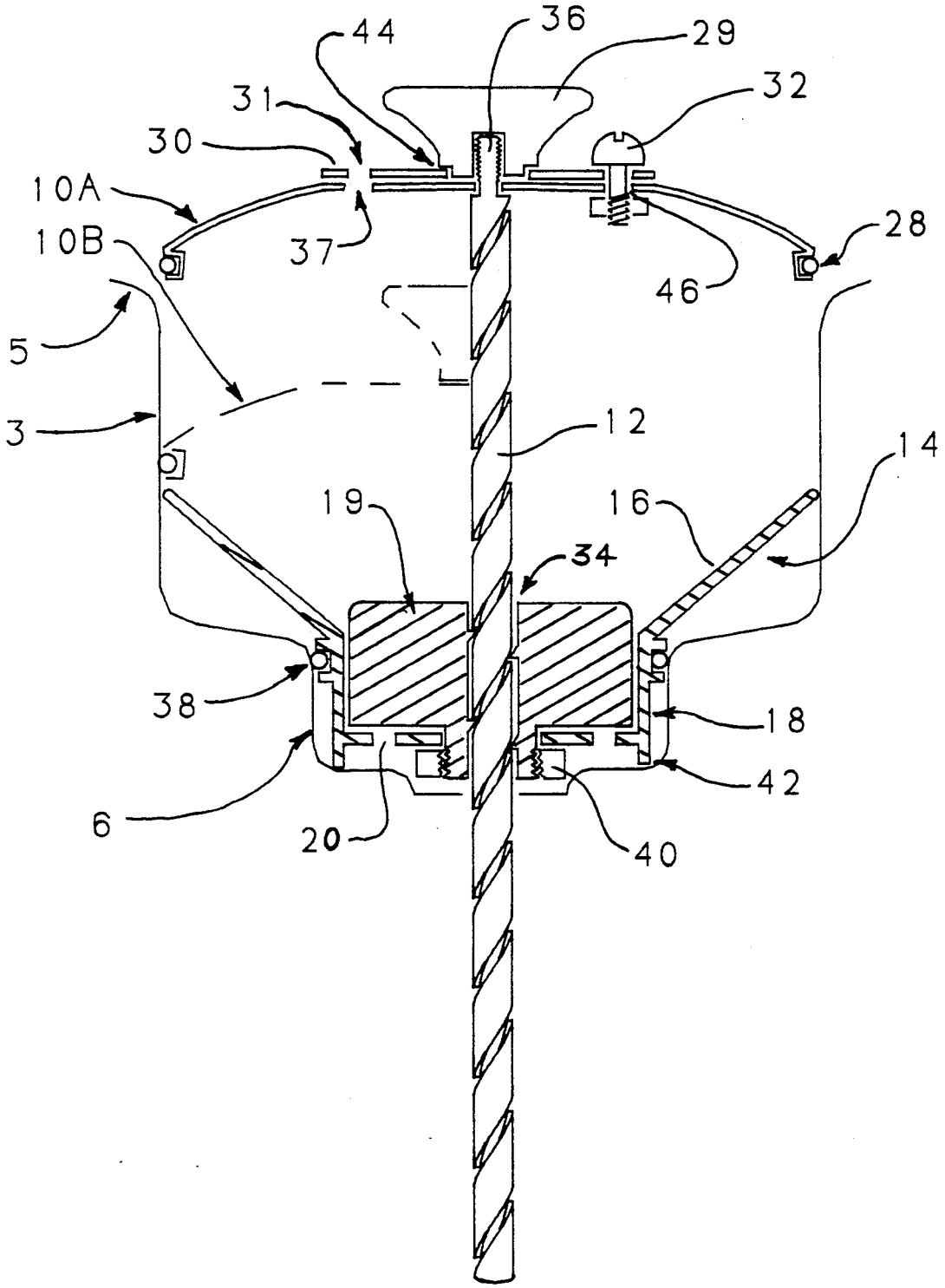
FIG. 3 is a frontal cross-sectional view of the invention situated within the outline of a sink drain.
Figure 4:
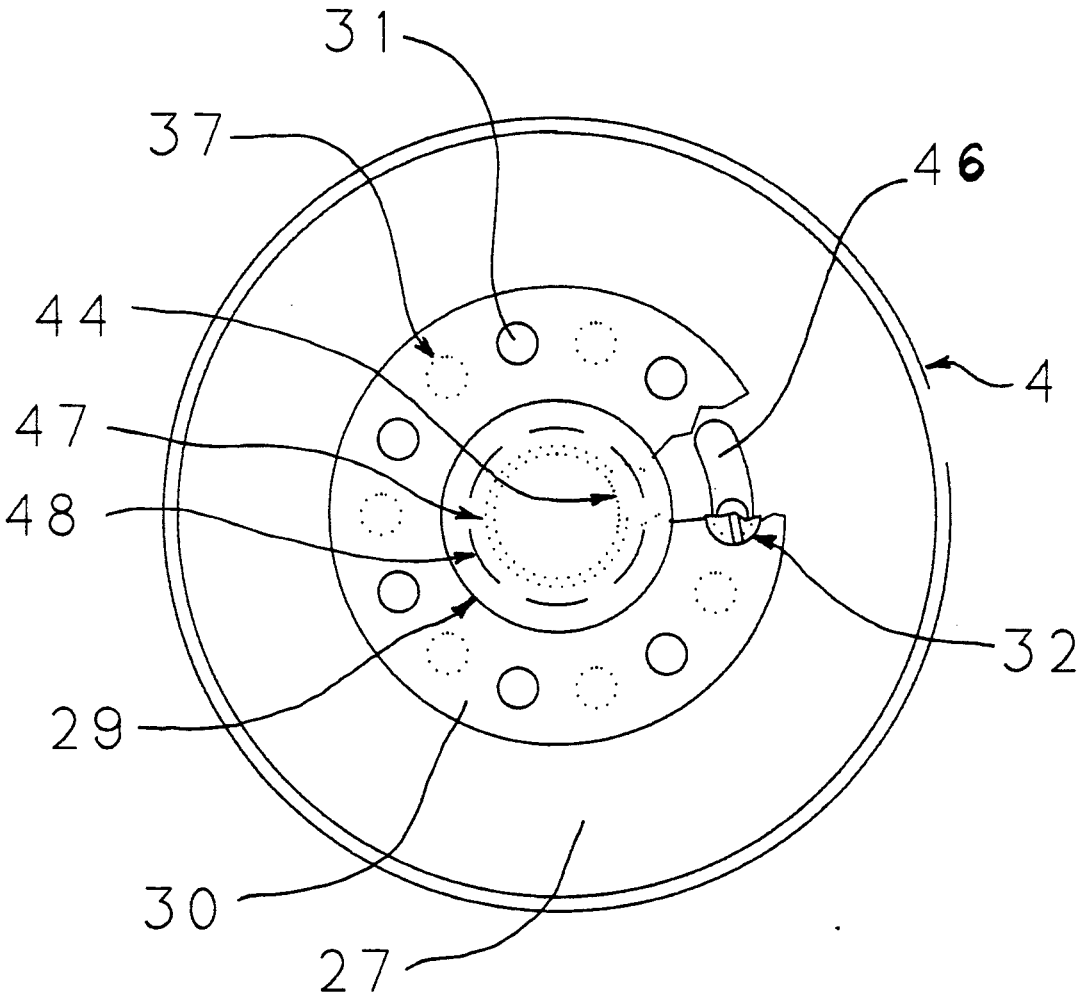
FIG. 4 is a top view of the invention emphasizing the cap assembly.

A gate disc 30 is mounted rotatably upon the knob 29 such that its perforations 31 may be aligned with the cap piece perforations (which are best shown in FIG. 3 labeled #37). To aid in rotating the gate disc, a gate disc nub 32 is provided which protrudes through the cap piece 27 in a concentric slot (which is best shown in FIG. 4 #46). A simple screw and nut can perform the structural function of this nub.

FIG. 3 is a frontal orthogonal cross-sectional view of the invention, the cross-section being through the diameter chord of the various circular components. The common sink drain outline is shown with the main cylinder wall portion 3 and the plug recess portion 6. The receptacle assembly 14 is inserted within the main cylinder and plug recess cylinder walls. A groove 38 may be provided to place an O ring for improved sealing against the cylinder surface.

In this figure, the rotor 19 is shown extending through a central hole in the rotor recess 18 to which it is held by a retainer nut 40. To provide clearance for the free spinning of the rotor and retainer nut 40, the rotor recess 18 may require footing protrusion 42 to seat upon the bottom of the plug recess 6 of the common sink drain.

Rotor 19 is shown with its central bore 34 matched to the threaded shaft 12. The threaded shaft is attached to cap assembly 10 by a screw on knob 29 which fixes the cap piece 27. Gate disc 30 has perforations 31 which may be aligned with perforations 37 in the cap piece. The gate disc 30 rotates within a recess 44 of the knob 29. A gate piece nub 32 aids in rotation of the gate piece; the nub may be provided as a simple inserted screw which may protrude through the cap piece into a concentric slot 46 provided in the cap piece. The concentric slot can be situated on the cap piece so as to allow two extremes of rotation from one limit, where the perforations 31 of the gate disc align to the perforations 37 of the cap piece, and another limit which defines gate disc closure (non-alignment). The concentric slot 46 is shown best in top view of the cap in FIG. 4.

The cap piece may be moved into the diameter of the main cylinder 3 of the drain where further movement from 10A to 10B provides compression impetus for the egress of liquid through the perforations 20 of rotor recess 18. The provision of a groove 28 for an O ring may assure a better fit for sealing the cap piece 27 against the main cylinder side wall 3.

The cap piece 27 is shown mounted with convexity upward which may be preferred by a user who prefers for food debris to slide off of the cap into the receptacle assembly 14 below.

As can be seen, egress of liquid from the sink may be accomplished either by lifting the entire cap assembly above the flared lip 5 of the sink drain, or by aligning the perforations of the gate disc 30 to the open position when the cap piece is within the main cylinder 3.

Strokes applied to the threaded shaft 12 impart spin to the rotor 19 which moves within the rotor recess 18 where trapped food debris may be sheared. The blades of the rotor may be substantially blunt and harmless to touch and still provide the shearing action by choice of appropriate clearance with the side walls. As can be seen in the side view of FIG. 3, the clearance between rotor and the bottom of the rotor recess, can be obtained by provision of a thrust washer or an integral thrust surface at the bottom of rotor 19.

FIG. 4 is a top view depiction of the cap assembly showing knob 29 and the gate disc 30 with central diameter 47 which rotates around the recess 44 diameter while being retained within the recess outer diameter 48. Through a cut away portion of the gate disc 30, concentric slot 46 is shown beneath gate disc 30 where it provides limits on the movement of gate disc nub 32 which protrudes downward into the concentric slot.

As depicted, gate disc perforations 31 are not aligned with cap piece perforations 37. Movement of the nub to the counter-clockwise extreme of the concentric slot 46 results in alignment and fluid passage. Whether the cap piece 27 is mounted convexity upward or downward, it is preferred to mount the gate piece 30 on the upper surface, not only to rotate within the recess 44 provided, but to be subjected to water pressure forcing it against the cap piece (when not aligned).

Figure 5:
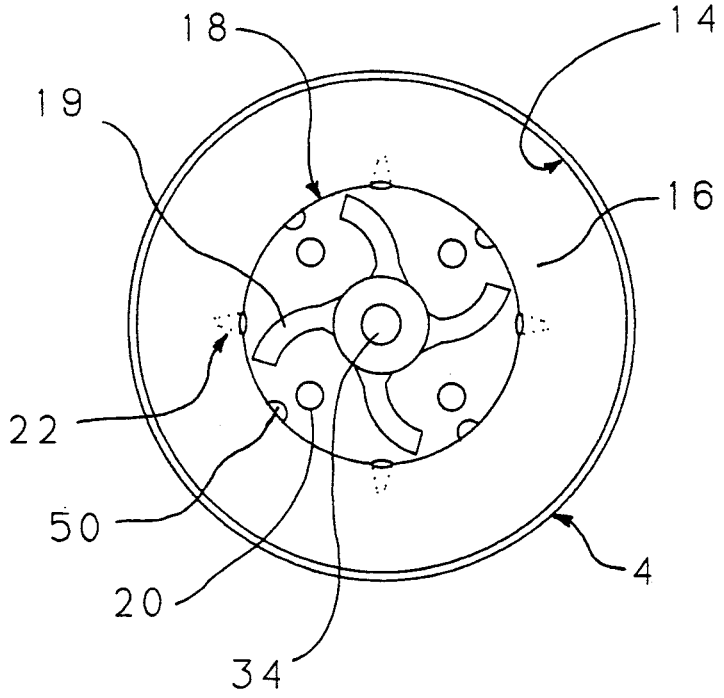
FIG. 5 is a topview of the receptacle assembly and rotor.

FIG. 5 is a top view of a receptacle assembly with rotor in place. The funnelling portion 16 of the assembly converges to the rotor recess 18

Bottom perforations 20 and dormer perforations 22 are shown as well as corner perforations 50 which may be placed at the intersection of the bottom and cylindrical surfaces of the rotor recess. The dormer perforations 22 are shown as having valley creases depicted by dotted lines in the top view. The rotor 19 within the rotor recess is shown with curved blades which may provide a crushing or compression action as well as shearing action upon food debris. In clockwise direction of rotation, the curved blade presents a converging surface to debris which may be wedged against the cylindrical side wall of the rotor recess.

In regard to rotor blade shaping, various edges may be preferred, including squared edges and hollow ground squared edges. Serrated indentation may be provided on either corner (leading or trailing) of a squared edge. For instance, on a curved blade the preferred corner for serrations would be that corner contiguous with the convex curved surface of the blade (the clockwise leading corner in FIG. 5) where the serrations may help to entrap wedged debris even further.

From the illustrated mechanisms it can be seen that portions of the components may be provided either from metal sheet or in cast material, either metal or specified synthetic materials.

The receptacle assembly may be provided as an inserted assembly within the constraints of standard sink drain dimensions. There can be advantage to having a receptacle assembly that can be removed for inspection and cleaning, including to shake and invert the receptacle assembly to remove hard debris which cannot be fragmented by the rotor method. The cap assembly as attached to the threaded shaft can also be removable simply by a complete up lifting out of the threaded bore of the rotor.

Of course a common fixed sink drain can be reshaped to offer different dimensions to receive a removable receptacle assembly with larger dimensions or other desirable shapes, and such a non-standard sink drain could be attached to sink and pipe trap as is a standard drain. Furthermore a sink drain may be designed to have components, such as the rotor recess and a mounted rotor, integral with the drain and permanently fixed to the sink and piping, abstaining from the advantages of removability.

The receptacle assembly need not have a funnelling region converging to a rotor recess, if it is preferred to have a larger rotor operating within a recess that approaches the available diameter of the main cylinder of an ordinary sink drain. Other shapes of cap pieces including a flattened disc may be preferred. Other shapes of a threaded shaft may be employed to impart motion to a matched rotor, including a twisted shaft square shaft such as is known in simple toys.

Among the working principles employed in the invention are the provision of a cylindrical recess detaining debris at perforations, a rotatable shearing part, actuated by the linear action of a steep pitch threaded shaft. The cap assembly adds elements of a grip for manual use, a means to drain and filter debris in exclusion from the region of the cutting rotor. Additionally, the cap assembly allows for the final compression of fluid at the bottom of each stroke applied to the threaded shaft. Thusly, the bottom range of each stroke if carried out would require force which can impel debris and fluid through perforations of the rotor recess region situated below it.

It can be seen that variations in shape of the components to realize various advantages would not depart from the working principles disclosed in the invention. The embodiment employed to accomplish the principles is depicted above and defined further in the claims which follow.

I claim:

1. A device for agitating, fragmenting, and cleaning debris carried in fluid which is drainage of a sink comprising:

a receptacle assembly placed within a cylindrical sink drain wherein a perforated receptacle has a concavity which intercepts said fluid in the course of said drainage, a rotor mounted within said concavity of said perforated receptacle assembly and enabled to rotate and having blades which rotate in relation to inner surfaces of said perforated receptacle, a threaded shaft mounted in and passing through a central bore of said rotor and said shaft and bore of rotor having matched threads, wherein said rotor is rotated in relation to said perforated receptacle in accordance with linear motion of said threaded shaft which is pushed or pulled through said rotor by manual force.

2. A device as claimed in claim 1 wherein said perforated receptacle includes a recess with curved sidewalls and a bottom, said recess having first perforations which allow for egress of fluid and detention of debris, said rotor edges situated near enough to said first perforations to impart shearing action against said detained debris during rotation of rotor.

3. A device as claimed in claim 2 wherein said first perforations include perforations in said curved sidewalls, perforations in said bottom, and perforations at the interface of said curved sidewalls and said bottom.

4. A device as claimed in claim 2 wherein said receptacle includes a funneling portion inclined and converging to said recess and said first perforations.

5. A device as claimed in claim 1 wherein a cap assembly is attached to the upper end of said threaded shaft, wherein said cap assembly includes a circular cap piece of a diameter which is able to cover and exclude debris from said perforated receptacle and stop passage of said sink fluid.

6. A device as claimed in claim 1 wherein said cap piece contains second perforations.

7. A device as claimed in claim 6 wherein said cap piece second perforations may be covered and obstructed wherein a second, substantially flat, gate piece is rotatably attached adjacent to said cap piece, said gate piece containing third perforations, said gate piece providing unobstructed opening of said second perforations when rotated to align said second and third perforations.

8. A device as claimed in claim 1 wherein a circular cap piece is attached to the upper end and user end of said threaded shaft, said receptacle assembly includes a cylindrical upper portion, said circular cap piece has a diameter that fits within said cylindrical upper portion, said cap piece moved within said cylindrical upper portion of receptacle imparts compressive force to liquid and material within said receptacle, said receptacle containing first perforations allowing egress of liquid and material under said compressive force.

9. A device as claimed in claim 8 wherein said receptacle assembly has a diameter which can fit within a commonplace sink drain, a circular cap piece is fitted to the user end of said threaded shaft, said cap piece has a diameter which can fit within the diameter of said commonplace sink drain, movement of said cap piece within the cylindrical common sink drain imparts a compressive force to materials within said receptacle assembly, said receptacle assembly contains perforations which allow egress of materials in the receptacle assembly responding to said compressive force.

10. A device for trapping, agitating, and disintegrating matter from liquid drainage in a sink wherein a sink has provided in its bottom a recess having cylindrical side walls and through which said liquid drainage may pass, a central support is provided with radial connection to said side walls, a rotor is mounted rotatably and centrally on said central support, said rotor is enabled to rotate with a clearance against said recess which allows that matter may be sheared against said recess, said recess has perforations which allow fluid egress and entrapment of matter, said rotor has a threaded central bore which matches a steeply pitched threaded rod which passes through said rotor and said central support, such that linear actuation of said threaded rod pushed or pulled through said rotor rotates said rotor in relation to said recess.

* * * * *